US006718705B2

(12) United States Patent
Emek

(10) Patent No.: US 6,718,705 B2
(45) Date of Patent: Apr. 13, 2004

(54) RESISTANT WINDOW SYSTEMS

(75) Inventor: Mordechay Emek, Kfar Shmaryahu (IL)

(73) Assignee: Arpal Aluminum Ltd., Lod (IL)

( * ) Notice: Subject to any disclaimer, the term of this patent is extended or adjusted under 35 U.S.C. 154(b) by 0 days.

(21) Appl. No.: 10/319,614

(22) Filed: Dec. 16, 2002

(65) Prior Publication Data

US 2003/0089052 A1 May 15, 2003

Related U.S. Application Data

(60) Division of application No. 09/501,000, filed on Feb. 9, 2000, now Pat. No. 6,494,000, which is a continuation-in-part of application No. 09/401,656, filed on Sep. 23, 1999, now Pat. No. 6,497,077.

(30) Foreign Application Priority Data

Mar. 11, 1999 (IL) ..... 128936

(51) Int. Cl.[7] ..... E06B 3/988

(52) U.S. Cl. ..... 52/204.69; 52/204.62; 52/204.597; 52/204.7

(58) Field of Search ..... 52/204.597, 204.62, 52/204.69, 204.7

(56) References Cited

U.S. PATENT DOCUMENTS

| | | | | |
|---|---|---|---|---|
| 170,702 A | | 12/1875 | Beckert, Jr. | |
| 198,822 A | | 1/1878 | Stone | |
| 856,856 A | | 6/1907 | Farmer | |
| 1,679,513 A | | 8/1928 | Brown | |
| 2,182,546 A | | 12/1939 | Raymond | |
| 2,200,692 A | | 5/1940 | Fairley | |
| 2,598,610 A | | 5/1952 | Satz et al. | |
| 2,694,842 A | | 11/1954 | Scott et al. | |
| 3,732,659 A | * | 5/1973 | LaBarge | 52/204.597 |
| 3,846,948 A | * | 11/1974 | Dallen | 52/204.597 |
| 4,006,569 A | * | 2/1977 | Kain | 52/204.597 X |
| 4,160,348 A | * | 7/1979 | Chapman et al. | 52/204.597 X |
| 4,364,209 A | * | 12/1982 | Gebhard | 52/204.597 |
| 4,420,905 A | | 12/1983 | Kucharczyk | |
| 5,232,260 A | | 8/1993 | Lippard | |
| 5,934,111 A | | 8/1999 | Hernandez | |

FOREIGN PATENT DOCUMENTS

| | | |
|---|---|---|
| EP | 0 189 813 | 1/1986 |
| GB | 7403 | 4/1900 |
| GB | 533041 | 9/1939 |
| GB | 520677 | 5/1940 |

* cited by examiner

*Primary Examiner*—Anthony D. Barfield
(74) *Attorney, Agent, or Firm*—Oliff & Berridge, PLC

(57) ABSTRACT

A blast resistant window system comprising a reinforced window pane defining an in-side and an out-side and being supported by a window framework for mounting at an opening in a wall. The window system further comprises at least one pane-engaging member transversally extending adjacent an in-side surface of the window pane and secured at respective ends thereof to opposite construction elements. Each of the pane-engaging member is fitted with at least one energy dispensing device for converting axial force within the pane-engaging member into mechanical work.

8 Claims, 15 Drawing Sheets

RESISTANT WINDOW SYSTEMS

This is a Division of application Ser. No. 09/501,000 filed Feb. 9, 2000 now U.S. Pat. No. 6,494,000 which is a Continuation-in-Part of application Ser. No. 09/401,656 filed Sep. 23, 1999 now U.S. Pat. No. 6,497,077 of the prior application is hereby incorporated by reference herein in its entirety.

FIELD OF THE INVENTION

The present invention is in the field of resistant window systems providing improved protection for individuals and equipment against respective injury and damage by fragments of the window pane flying into the protected structure. The invention is also concerned with some specific mechanisms for use in conjunction with blast resistant window systems in accordance with the invention. The term "window" refers to a variety of window types, e.g. swingable/tiltable casement windows, fixed windows, curtain walls, etc.

Hereinafter in the specification and claims, the terms "window" and "windows" are interchangeably used with door and doors, respectively.

BACKGROUND OF THE INVENTION

Casement windows typically comprise a rectangular framework consisting of a frame anchored within an opening in a wall and sash swingably mounted thereon with locking means preventing unintending opening thereof. Casement windows are either or both swingable inwards or outwards and at times, are also tiltable.

Fixed windows are those windows wherein the framework is fixed within an opening in a wall and which are not capable of swinging or tilting about one or more axis. Sliding windows are those windows which are slidingly received and concealed within an opening in the wall or, alternatively, slidable along a suitable railing parallel to the wall.

Curtain walls are those glass panels which are used, in particular, for decoration and concealing structural elements of buildings, creating a building's envelope. Curtain walls also protect the building structure from weather effects and damage. The design and construction of curtain walls is such that vertical loads are not transferred between floors of a building.

The present invention is directed to all types of windows and doors and accordingly, the terms "window sash" and "window frame" may be used alternatively, depending on the context and the type of window or door described.

Curtain walls are nowadays often used. Such curtain walls are constructed of large glass panes supported to transversely extending frame members (referred to in the art as mullions and transums), enveloping the construction of a building and providing a pleasing and esthetic appearance of the building.

Windows which are designed to resist blasts caused, for example, by an explosion, are so designed such that the window frame and window sash remain in place although, deformation thereof is allowed up to a certain extent. In some cases, the window pane may detach from the frame at low energy, so as not to fly into the room. In such windows, the window pane itself is blast resistant too and is typically, although not explicitly, made of several layers of glass with reinforcing material embedded therebetween, such as, for example, flexible polymeric material. Generally, blast resistant windows are designed also to prevent noxious gases from entering a confined room space.

Several patents deal with reinforcing means for ensuring that the window sash remains in place during a blast. Other patents deal with methods for reinforcing the window pane. Such reinforcing may be by embedding suitable wiring or elastomeric material.

However, during a blast, the glass component of the window pane breaks, and although remains attached to the reinforcing layers of the window pane, the entire window deforms and might forcefully disengage from the supporting window sash and fly into the room, causing severe damage to equipment or injury to personnel within that room.

It is an object of the present invention to provide blast resistant window systems in which the window pane is prevented from blowing forcefully into the room upon an external blast or upon applying kinetic energy thereto, e.g. by crowds pushing against the window pane or by ballistic impact such as bullets or shrapnel of bombs. This main object is achieved by absorbing the deformation and displacement of the window pane in a direction perpendicular to the window pane and converting it into mechanical energy which is either dampened or, preferably, wasted e.g. by converting it into heat or mechanical work. The wasted and dampened energy is transferred to the window framework (window sash or window frame or frame members in case of a curtain wall) or to construction elements of the building, e.g. wall or columns, by a suitable energy dispensing system.

The term "energy dispensing device" used hereinafter in the specification and claims denotes any mechanical arrangement or mechanism suitable for converting one form of mechanical energy into another form e.g. displacement work into heat or into other mechanical work such as plastic deformation, elastic deformation, sheer, etc.

As already pointed out hereinabove, the present invention is applicable to any type and form of window or door, mutatis mutandis.

SUMMARY OF THE INVENTION

In accordance with a first aspect of the present invention there is provided a blast resistant window system fitted with an energy dispensing (wasting) device.

In accordance with a first aspect of the present invention there is provided a blast resistant window system comprising a reinforced window pane defining an in-side and an outside and being supported by a window framework for mounting at an opening in a wall; the window system characterized in that it further comprises at least one pane-engaging member transversely extending adjacent an in-side surface of the window pane and secured at respective ends thereof to opposite construction elements; each of the at least one pane-engaging member is fitted with at least one energy dispensing device for converting axial force within the pane-engaging member into mechanical work.

The term "construction elements" denotes opposite window framework profiles (sash profiles), opposite wall portions and opposite support profile attached to respective wall portions (single profiles or such the\at together construct a frame).

The energy dispensing device may be a separate device or may constitute a component of the framework.

In accordance with a preferred embodiment, the window is a casement window and the framework comprises a sash mounted on a window frame fixed at the opening in the wall; the at least one pane-engaging member being secured to and extending between either or both pairs of top and bottom rails, and hanging and shutting stiles of the window sash. Alternatively, there may be provided profiled members fixed at opposite wall portions, wherein the one or more pane-engaging members are secured at their ends to respective such profiles.

By a modification, when the window constitutes part of a curtain wall, the framework comprises a plurality of substantially transversely extending frame members, and wherein the at least one pane-engaging member is secured to respective such frame members.

Where the window constitutes part of a curtain wall, at least some of the pane-engaging member may extend within frame members whilst other pane-engaging members extend transversely across the window pane. This arrangement provides also improve reinforcement of the frame members of the curtain wall. This arrangement may be applied also to other types of windows, as can be readily realized.

The pane-engaging member is typically a cable or cord made for example of steel wire, advanced technology material such as complex material, etc. retaining their flexibility.

In accordance with any of the above embodiments, the at least one energy dispensing device may be fitted anywhere along the respective pane-engaging member or (instead or in addition) at or adjacent respective ends thereof.

At least some of the one or more energy dispensing devices may be concealed within the sash or window frame member (in case of casement windows etc.) or within the frame members or support profiles (in case of a curtain wall).

The energy dispensing device is adapted for wasting mechanical energy and converting it into different forms of energy for preventing the window pane from flying into the protected room. This may be achieved by directing the energy to the framework of the window. Alternatively, the energy dispensing device is adapted for dampening the energy and wasting it in a different form, e.g. heat or elastic, gained energy.

By one preferred embodiment, the energy dispensing device is adapted for converting axial displacement of the pane-engaging member into plastic deformation or into mechanical sheer. By one specific design, the energy dispensing device may be part of the framework or of the support profiles. In accordance with a different embodiment, the energy dispensing device comprises an elastic member for temporarily gaining and then releasing the energy. Alternatively, the energy dispensing device comprises a piston and cylinder assembly wherein axial displacement energy is converted into heat.

In accordance with one specific embodiment, the energy dispensing device comprises an elastic member having a longitudinal axis coaxial with that of the pane-engaging member; the elastic member bears at one end thereof against an end plate of the pane-engaging member, and at an opposed end thereof against a corresponding member of the window framework or support profile.

In accordance with a different specific embodiment the energy dispensing device is a tubular element formed with one or more substantially radially extending recesses, wherein applying axial force thereon entails plastic deformation of the tubular element. In accordance with a modification of this embodiment the tubular element bears at a first end thereof against a member of the framework, and at a second end thereof it is integral with or bears against a respective end plate of the pane-engaging member.

In accordance with another design, the energy dispensing device comprises a tubular element formed with at least one substantially radially extending rib, and a sheering member adapted for sheering the at least one rib upon coaxial displacement of at least one of the tubular element and the sheering member with respect to one another.

Alternatively, one of the tubular element and the sheering member is coupled to an end of the pane-engaging member or to a respective window framework member or support profile, and the other of the tubular element and the sheering member is articulated to the other of an end of the pane-engaging member and a respective window framework member or support profile, respectively.

In accordance with a specific design the sheering member is ring-like shaped and coaxially extends with respect to the tubular element, adapted for consecutively sheering the radial ribs.

The arrangement of the window system in accordance with the invention is such that deformation or displacement of the window pane in an inbound direction, entails engagement of the window pane with the pane-engaging member giving rise to axial force within the pane-engaging member. This may also be achieved wherein deformation or displacement of the window pane in a direction substantially perpendicular to the plane of the window pane entails engagement thereof with the pane-engaging member to generate an axial, tension force in the pane-engaging member.

In accordance with a second aspect of the invention there is provided an energy dispensing device for use in conjunction with a blast resistant window system, the device comprising a first member having a longitudinal axis and a second member; at least one of said first and second members being fixedly attachable to a respective end of a window pane-engaging member; one or both of the first and second members comprises at least one energy wasting member extending along the longitudinal axis, said at least one wasting member bearing against a cooperating surface of the respective other first and second member; wherein axial displacement of the first and second members with respect to one another is converted into a different form of work.

According to one specific design, one or both of the first and second members constitute component elements of the framework of the window.

The first and second members may be a piston and cylinder, respectively, adapted for converting displacement energy into wasted heat. By one specific embodiment a restraining arrangement is provided for dampening the axial displacement of the piston and cylinder, e.g. a viscous liquid provided in the cylinder and aperture of restricted size for restraining air escape from the cylinder, etc.

By a different embodiment of the second aspect of the invention, the first and second members may be elastic members which elastically deform upon applying axial displacement thereto and which tend to retain their original shape after a while.

In accordance with an embodiment of the second aspect of the invention, the axial displacement energy is converted into plastic deformation or sheering of the one or more energy wasting members. Preferably, the one or more energy wasting members are one or more radially extending ribs adapted for sheer or plastic deformation.

In accordance with a specific design the one or more energy wasting member is a tubular member formed with a plurality of radial slits adapted for plastic deformation upon applying axial force thereto. By still a specific design, the energy wasting member is adapted for consecutive wasting of mechanical work wherein the energy wasted along the axial axis increases along with increase of axial displacement of the first and second members with respect to one another.

By still a specific design of the preferred embodiment the first member is a core element formed with a plurality of laterally extending ribs and the second member is a sheering member receiving the first member and formed with an opening having a sheering surface bearing against a first of said ribs, said opening sized to admit access of the core element and sheer one or more of the ribs. Preferably, the sheering member is ring-like shaped.

The sheering member may be a housing accommodating at least one pair of orientation opposed, axially extending first members. In accordance with one specific design the sheering member is a housing accommodating at least one pair of orientation opposed, axially extending first members.

The housing may be fitted for fixedly attaching to a fixed construction element of the framework or wall wherein the fist member attached to the pane-engaging member is axially displaceable.

Typically, the pane-engaging member transversely extends adjacent and parallel to a blast resistant window pane, or within a profiled framework element.

In accordance with still a different aspect of the present invention there is provided a blast resistant window system comprising a reinforced window pane supported by a framework assembled of a plurality of profiled members and being receivable within an opening in a wall; a frame support member extending within the profiled members with at least one energy dispensing device fitted thereon; the frame work comprises a plurality of openings through which the frame support member projects for engagement with corresponding anchors fixed to the wall. By one particular design the profiled members are profiled.

In accordance with an embodiment of the latter aspect, the window is a fixed casement window and wherein the frame support member is made of a substantially flexible material.

Typically there is further provided a transversal member having its respective ends articulated to the frame support member; said transversal member being a pane-engaging member extending adjacent an in-side face of the window pane, or a frame support member extending through a corresponding transversal profiled member.

It will be appreciated that the energy dispensing device used in the blast resistant window system in accordance with the latter aspect of the present invention is in compliance with the energy dispensing devices disclosed hereinabove and in further detail in the specification.

Still, there may be provided at least one tensioning member extending within the profiled members, for tensioning the frame support member.

The term "wall portion" as used herein in the specification and claims refers collectively to structural elements, including walls, foundation structures of a building (such as columns, etc.) floor and ceiling.

The reinforced window pane used in accordance with any of the aspects of the present invention is typically a bullet, attack and blast resistant material typically made of sandwiched material, offering protection against vandalism (physical attack) kinetic energy of bullet and shrapnel, of blast, etc.

BRIEF DESCRIPTION OF THE DRAWINGS

In order to better understand the invention and to see how it may be carried out in practice, some preferred embodiments will now be described, by way of non-limiting examples only, with reference to the accompanying drawings, in which:

FIG. 5 are directed to another embodiment of an energy dispensing device, wherein:

FIG. 12 is a view of a fixed window fitted with a frame reinforcing assembly, wherein:

DETAILED DESCRIPTION OF A PREFERRED EMBODIMENT

Figure 1:
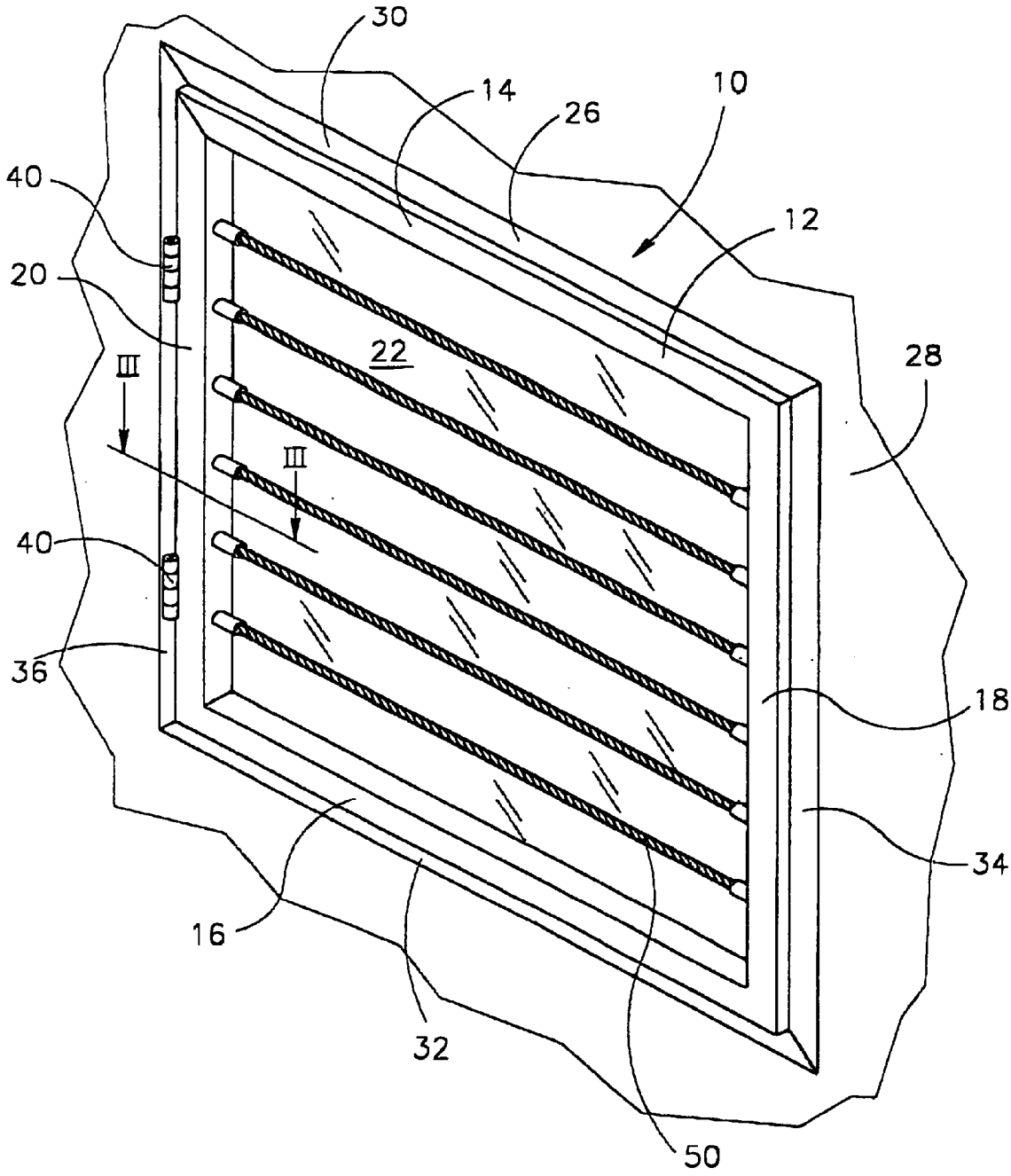
FIG. 1 is a perspective view of a casement window fitted in a wall and provided with a system in accordance with the present invention.

Reference is first made to FIG. 1 of the drawings, generally illustrating a rectangular framework of a casement window generally designated 10 comprising a window sash 12 consisting of profiled top rail 14, bottom rail 16, shutting stile 18 and a hanging stile 20, supporting between them a reinforced window pane 22 as known per se.

Typically, with a construction in accordance with the present invention, the window pane 22 is of a generally known reinforced type suitable for withstanding vandalism (physical attack), explosion blast and kinetic energy of bullets and shrapnel.

The framework 10 further comprises an outer frame 26 anchored within an opening in the wall 28 (with or without a wall frame) as known per se and consisting of an upper frame head 30, a lower frame sill 32, a side shutting jamb 34 and a side hanging jamb 36.

Figures 3A, 3B:
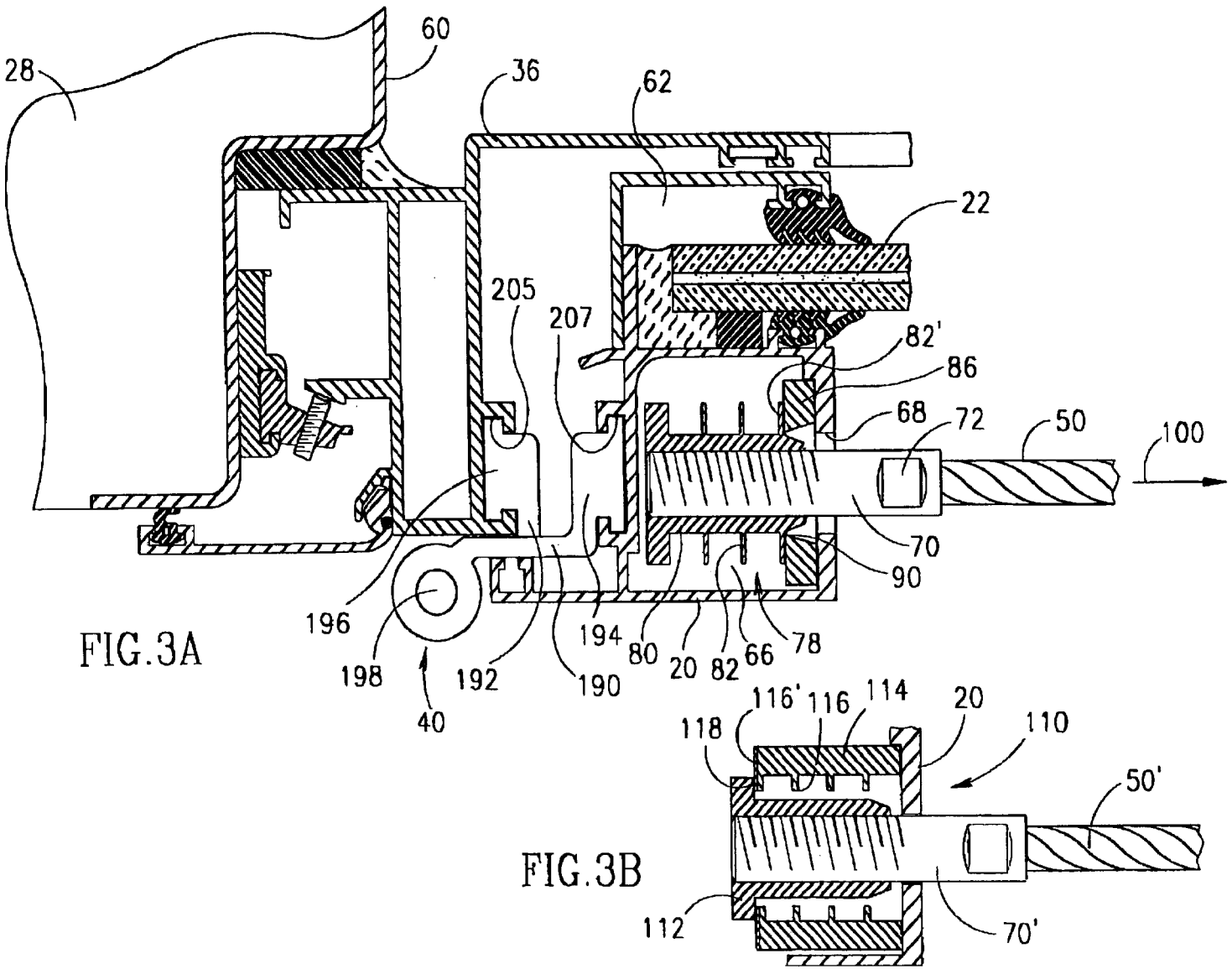
FIG. 3A is a cross-section through lines III—III in FIG. 1, illustrating a first embodiment of an energy dispensing device in accordance with the present invention.
FIG. 3B is a different embodiment of an energy dispensing device for use in a system according to the invention.

The window sash 12 is pivotally mounted with respect to frame 26 by means of hinges 40 secured respectively to hanging jamb 20 and hanging stile 36 as known per se and as can be seen, for example in sectional FIG. 3A.

Although not seen in the figures, it will be readily understood that the framework 10 is provided with suitable locking means which, if so desired may be reinforced locking means as known. However, alternatively, the window may be not a casement window but rather a fixed frame window (see FIGS. 6 and 11) with a difference in that no hinge means are provided and a locking mechanism is obviated.

Figure 2A:
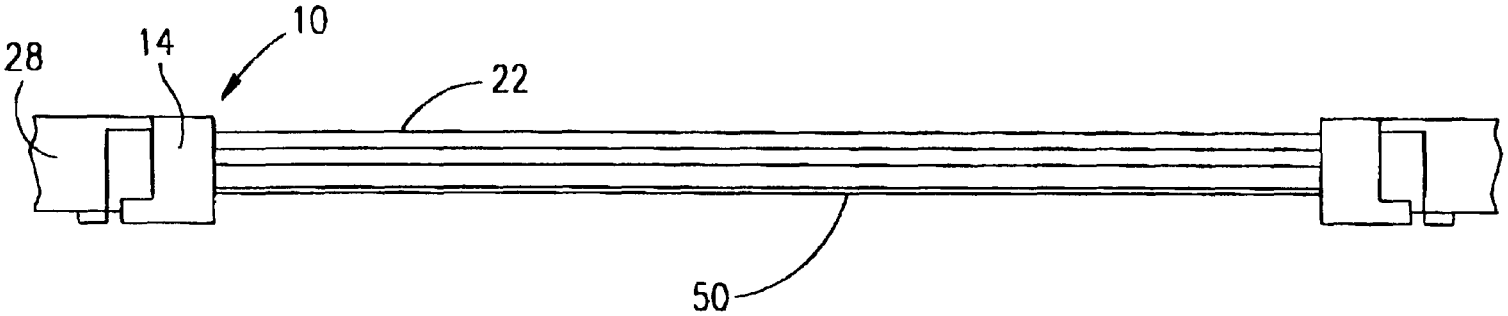
FIGS. 2A and 2B schematically illustrate a sectional view through a window fitted with an energy absorption system in accordance with the present invention in a normal state and under blast effect, respectively.

Window pane 22 is reinforced and is typically made of at least two layers with an intermediate reinforcing layer therebetween, typically made of a resilient polymeric material or a resin, as known in the art and as can be seen in FIG. 2A. In FIGS. 1 and 2, window pane 22 is fitted within framework 10 which is anchored within an opening of wall 28. An energy absorption system is provided and a plurality of pane-engaging members 50 are provided (only one seen in FIG. 2). The pane-engaging members are typically steel cables or wires the purpose of which will become apparent hereinafter. The pane-engaging members transversely extend across the window, adjacent and parallel an inside face thereof.

Pane-engaging member 50 may be made of any suitable flexible and non-elastic material such as steel cables, cords made of synthetic material woven into different shapes, composite materials, etc., as known in the art. However, according to a different embodiment, the cables may be made of elastic material.

Figure 2B:
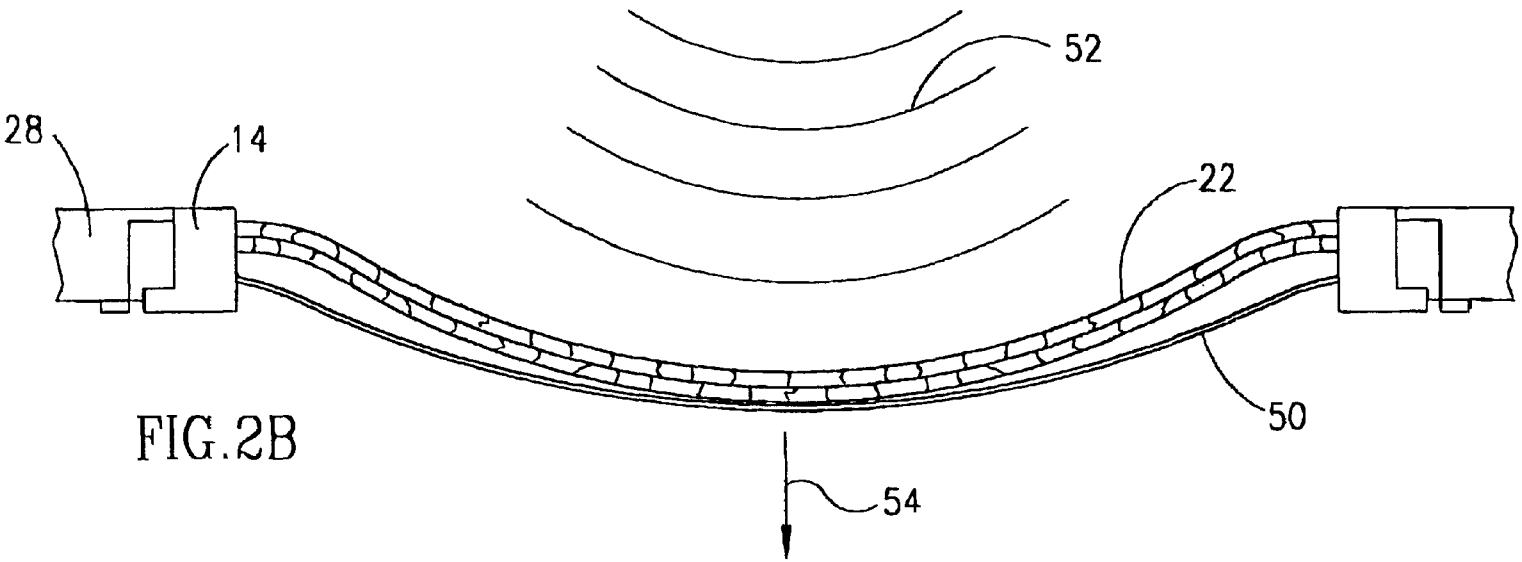

FIG. 2B illustrates the window of FIG. 2A under the influence of shock wave 52 caused for example by blast. In this situation, window pane 22 breaks to smithereens although they remain adhered to the intermediate reinforcing layer which is provided in order to prevent splinters from entering into a room and injuring people or damaging equipment. At the absence of pane-engaging member 50, the pane 22, in its deformed position seen in FIG. 2B, disengages from the window sash 14 and would forceably move in the direction of arrow 54, into a room, possibly causing severe damage and casualties. However, the pane-engaging members 50 prevents pane 22 from disengaging from the window sash 14 and wherein tensioning the pane-engaging members 50 by deformation thereof, is converted into mechanical energy which is transferred to the elements of the window sash, as will be explained hereinafter.

For better understanding the design of the energy dispensing system, reference is made to FIG. 3A. Hanging stile 20 is swingably mounted on hanging jamb 36 by means of hinges 40. Hanging jamb 36 is adjustably attached to wall frame 60 which in turn is anchored within an opening in wall 28. Blast resistant window pane 22 is secured and received within a suitable opening 62 in hanging stile 20.

Hanging stile 20 is a profiled member comprising a cavity 66 formed with lateral openings 68, existing also in the opposite, shutting stile 18 (not seen).

Figures 4A, 4B:
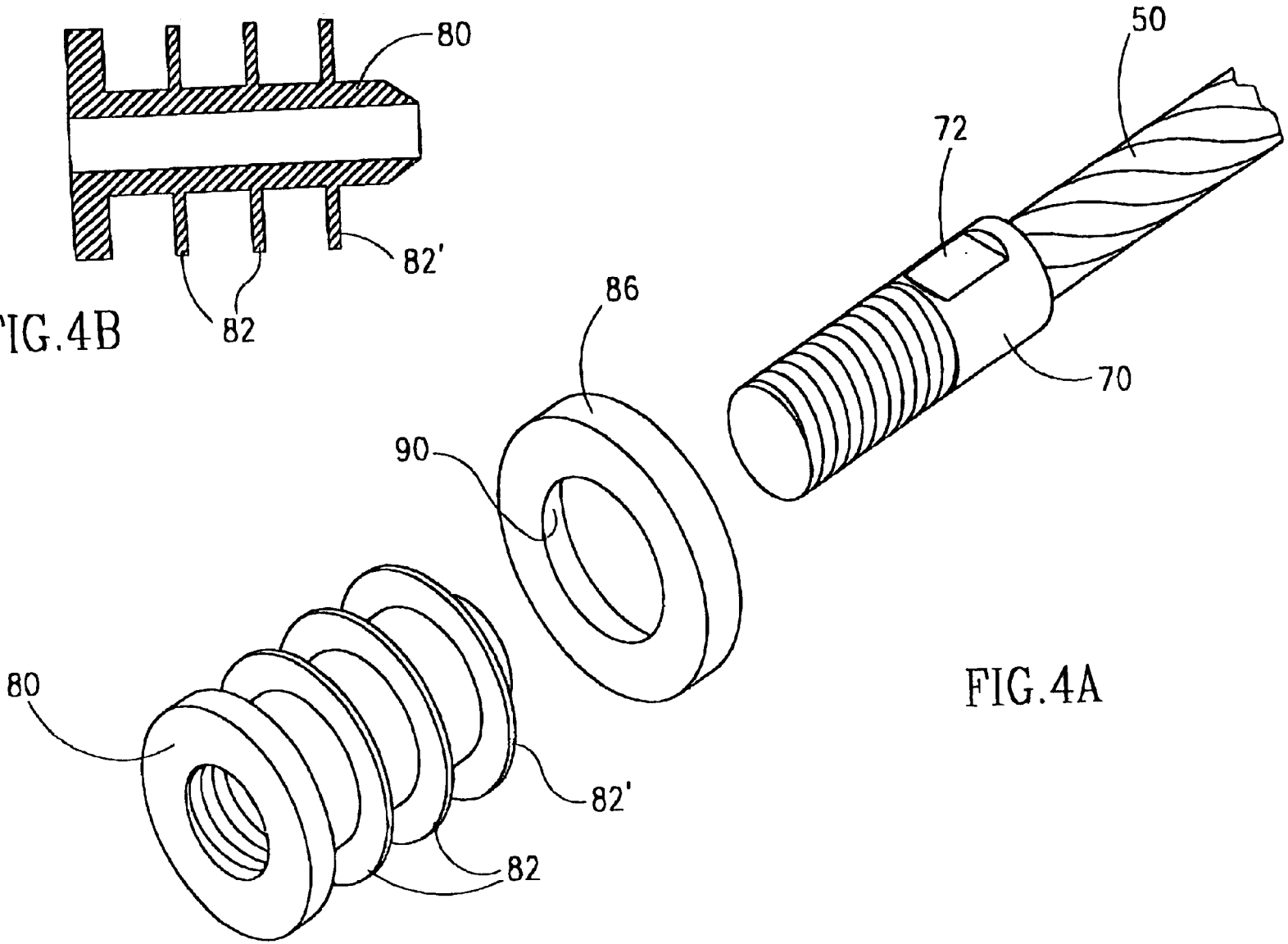
FIG. 4A is an exploded, perspective view of an energy dispensing device in accordance with a first embodiment of the present invention shown in FIG. 3A.
FIG. 4B is a cross-section through the tubular element seen in FIG. 4A fitted with radial ribs.

As can be seen in more detail in FIGS. 4A and 4B, pane-engaging member 50 is a steel cable terminating at a cable shoe 70, formed with two opposed flat surfaces 72 for facilitating rotation thereof by a wrench or the like. An end of cable shoe 70 is threaded and is inserted through opening 68 into cavity 66. An energy dispensing device generally designated 78 is screw-coupled to cable shoe 70 within the cavity 66 and comprises a tubular element 80 formed with a plurality of radially extending ribs 82. Sheering ring 86 is also mounted on cable shoe 70 within cavity 66.

The arrangement is such that sheering ring 86 bears at one face thereof against a profiled wall of the respective hanging or shutting stile 20 or 18 (the latter not shown) and an opposite face thereof bears against the first rib 82' with a circular sheering edge 90 resting at a root of rib 82.

During blast or displacement owing to some kinetic energy, the window pane deforms or displaces into engagement with the cable 50, entailing tensioning thereof in direction of arrow 100, resulting sheering of rib 82' by sheering ring 86 and then consecutive sheering of ribs 82, depending on the force applied to cable 50 by deformation of the window pane 22 bearing against the cable 50.

The thickness of ribs 82' and 82 is calculated so as to consecutively waste the energy imparted by sheering thereof. However, the thickness of the ribs may vary, depending on required sheering effect.

In FIG. 3B there is illustrated a somewhat different energy dispensing device generally designated 110 wherein similar to the embodiment of FIG. 3A, cable 50' is fixed at its respective ends within a cable shoe 70'. A sheering member 112 is screw-coupled on cable shoe 70' and a tubular element 114 is formed with inward radially extending ribs 116. One end of tubular element 114 bears against a wall of the profiled banging stile 20. A sheering edge 118 bears against a first rib 116' at a root thereof.

Similar to the embodiment of FIG. 3A, upon applying axial force within cable 50', ribs 116' and 116 are consecutively sheered, thus wasting the mechanical energy and preventing the window pane from flying into the room.

Figure 5A:
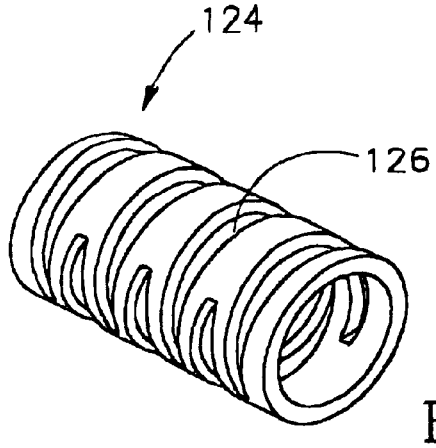
FIG. 5A is a perspective view of an absorbing element adapted for plastic deformation.
Figure 5B:
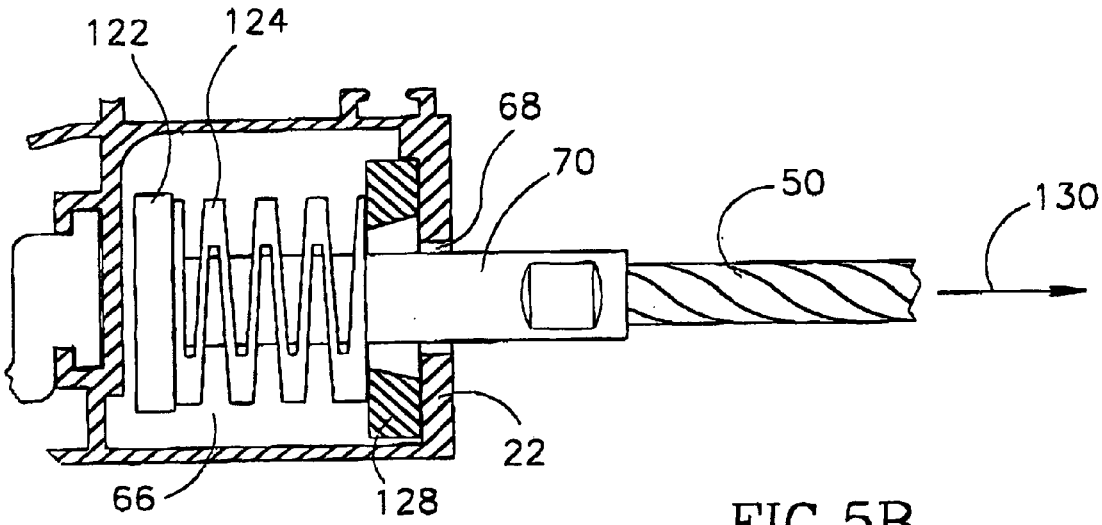
FIG. 5B illustrates the system in rest.
Figure 5C:
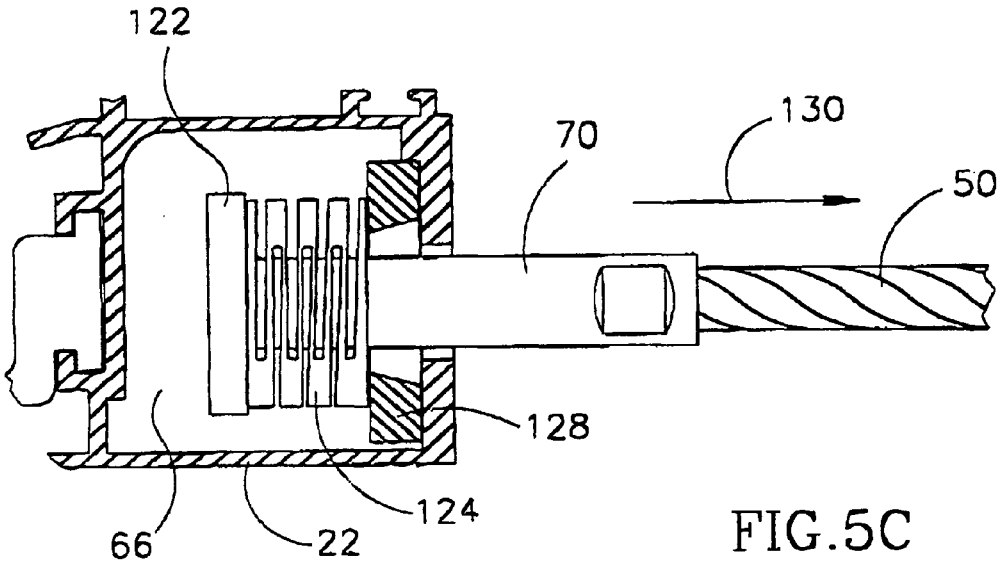
FIG. 5C illustrates the system during and after blast.

Further attention is now directed to FIGS. 5A–5C in which only principle components of the window are shown and the reader is directed to FIG. 3A and the description thereof for additional reference. Those elements which are similar to elements shown in FIG. 3A are given the same reference number.

As can be seen in FIG. 5B, pane-engaging member is a cable 50 which is fitted at its respective ends with a cable shoe 70 extending into cavity 66 of profiled hanging stile 22 through opening 68. An end disk 122 is screw-coupled at the end of cable shoe 70. Mounted on the cable shoe 70 between a wall at hanging stile 22 and the end disk 122, there is a tubular element 124 which is best seen in FIG. 5A. Tubular element 124 comprises a plurality of radially extending recesses 126 which, in the present example, are V-like shaped although, these recesses may also be planar recesses. Also mounted on cable shoe 70 is a ring 128 which in the present example is similar to sheering ring 86 seen in FIG. 3A.

The arrangement is such that when a blast occurs or upon applying severe force on the window pane 22, it deforms and engages cable 50, it generates a force component in direction of arrow 130, thus entailing plastic deformation of tubular member 124 as shown in FIG. 5C, preventing the window pane 22 (not shown) from flying into the space of the room.

The artisan will appreciate that the recesses formed in tubular member 126 may be of different size and disposed at varying distances, depending on mechanical stress design parameters for obtaining the required results.

Figure 6B:
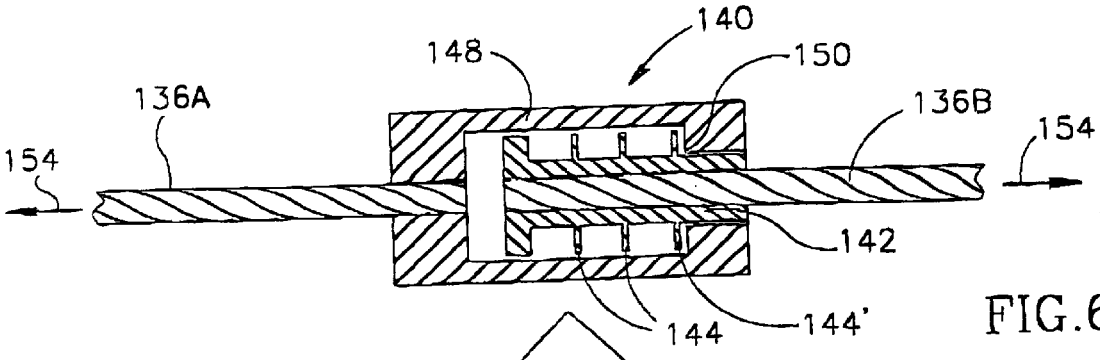
FIG. 6B is an enlarged sectional view of an energy dispensing device seen in FIG. 6A.
Figure 6A:
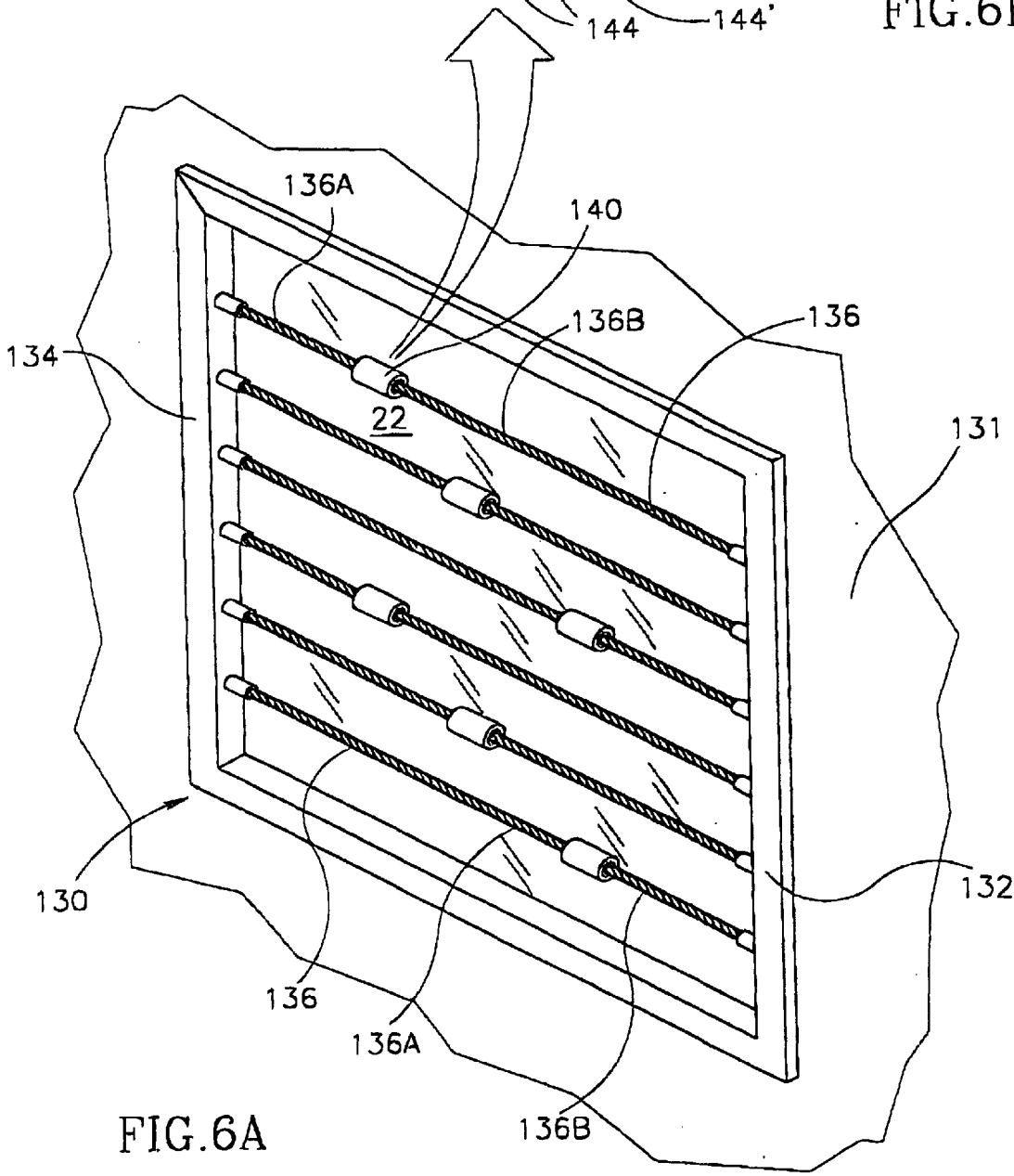
FIG. 6A schematically illustrates a different embodiment of a blast resistant window fitted with an energy dispensing system in accordance with the present invention.

Attention is now directed to FIG. 6. In this embodiment, the window is not a casement window but is rather a fixed window frame generally designated 130 and fixed within an opening in wall 131. Transversely extending between side profiles 132 and 134 of the window frame 130 are a plurality of cables 136 secured at their respective ends to the profiles 132 and 134. Alternatively, as previously mentioned and as can be readily be understood, the cables may be secured at their respective ends to opposite wall portions supporting the window. This arrangement applies also in the case of curtain walls, wherein the cables may be attached to wall or construction members.

Each cable 136 in fact consists of two segments, namely 136A and 136B connected to one another via an energy dispensing device 140 which is seen in detail in FIG. 6B. The energy dispensing device 140 consists of a tubular element 142 formed with a plurality of radial ribs 144 and an opposite, sheering member 148 formed with a sheering edge 150 bearing against radial ribs 144'.

The arrangement is such that upon applying axial force in direction of arrows 154 (see FIG. 6B) for example in the case of a blast entailing deformation of window pane 22, the sheering edge 150 sheers ribs 154' and 154 from tubular element 142, thus wasting the mechanical energy.

Figure 7:
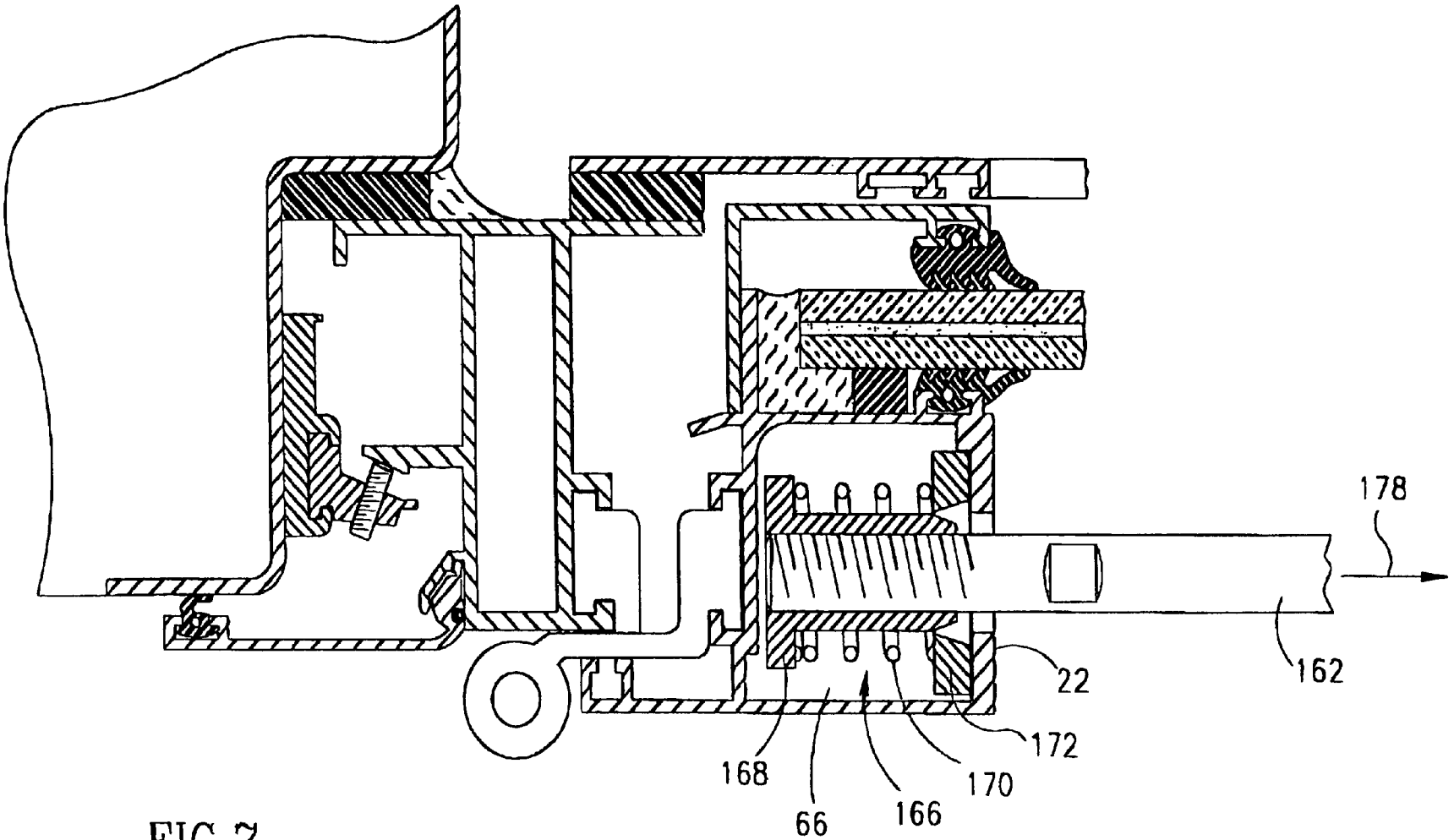
FIG. 7 is a cross-sectional view as in FIG. 3A, illustrating an energy dispensing device in accordance with a different embodiment of the present invention.

Still another embodiment is illustrated in FIG. 7 wherein rather than wasting the mechanical energy generated by a blast on plastic deformation or mechanical sheering, in this case the mechanical energy is dampened by a spongy element.

The structure of this embodiment is in fact quite similar to that illustrated with reference to FIG. 3A. In the present example, pane-engaging member is a steel rod 162 received within cavity 66 of the shutting stile 22. An end piece 166 is screw-coupled at an end of rod 162 with a shoulder element 168 formed at its remote end. A coiled compression spring 170 is mounted on the tubular element 166, bearing at one end thereof against ring 172 and at an opposed end thereof against shoulder 168. Alternatively, instead of coil spring 170, there may be provided an elastomeric member adapted for elastic deformation.

Upon blast, where the window pane is deformed and applies force on rod 162, axial force is generated in direction of arrow 178, entailing compression of spring 170, dampening the shock wave.

Figure 8A:
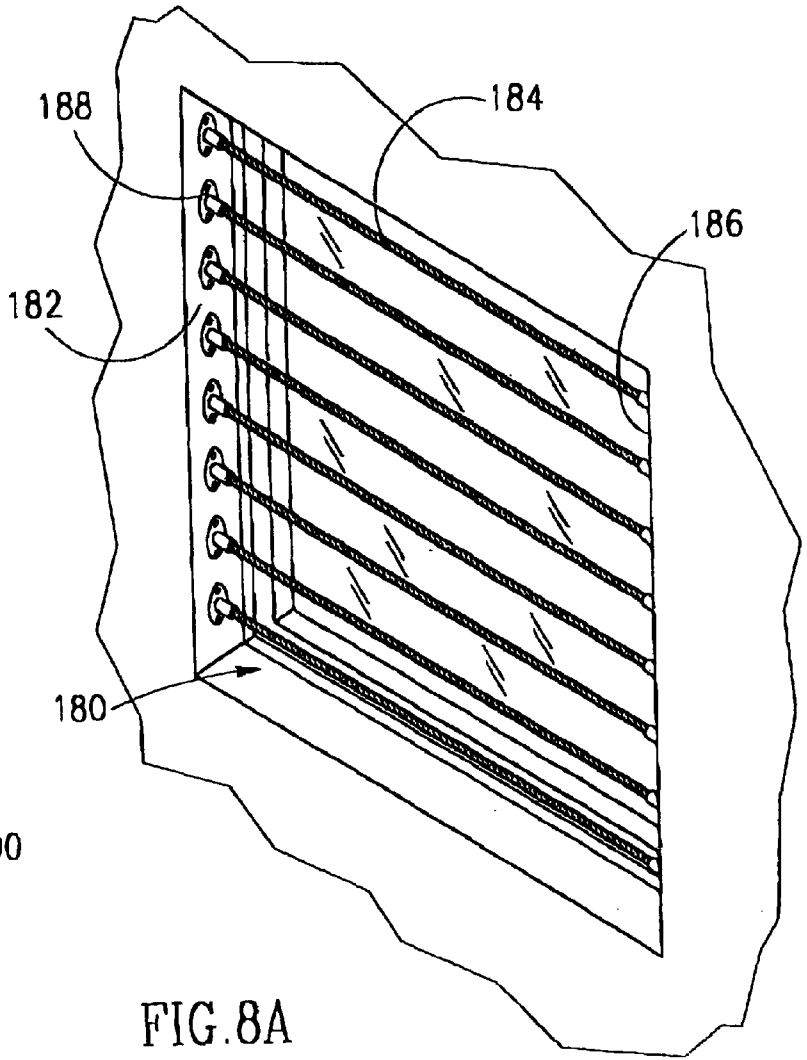
FIGS. 8A and 8B are different embodiments of windows in accordance with the invention.
Figure 8B:
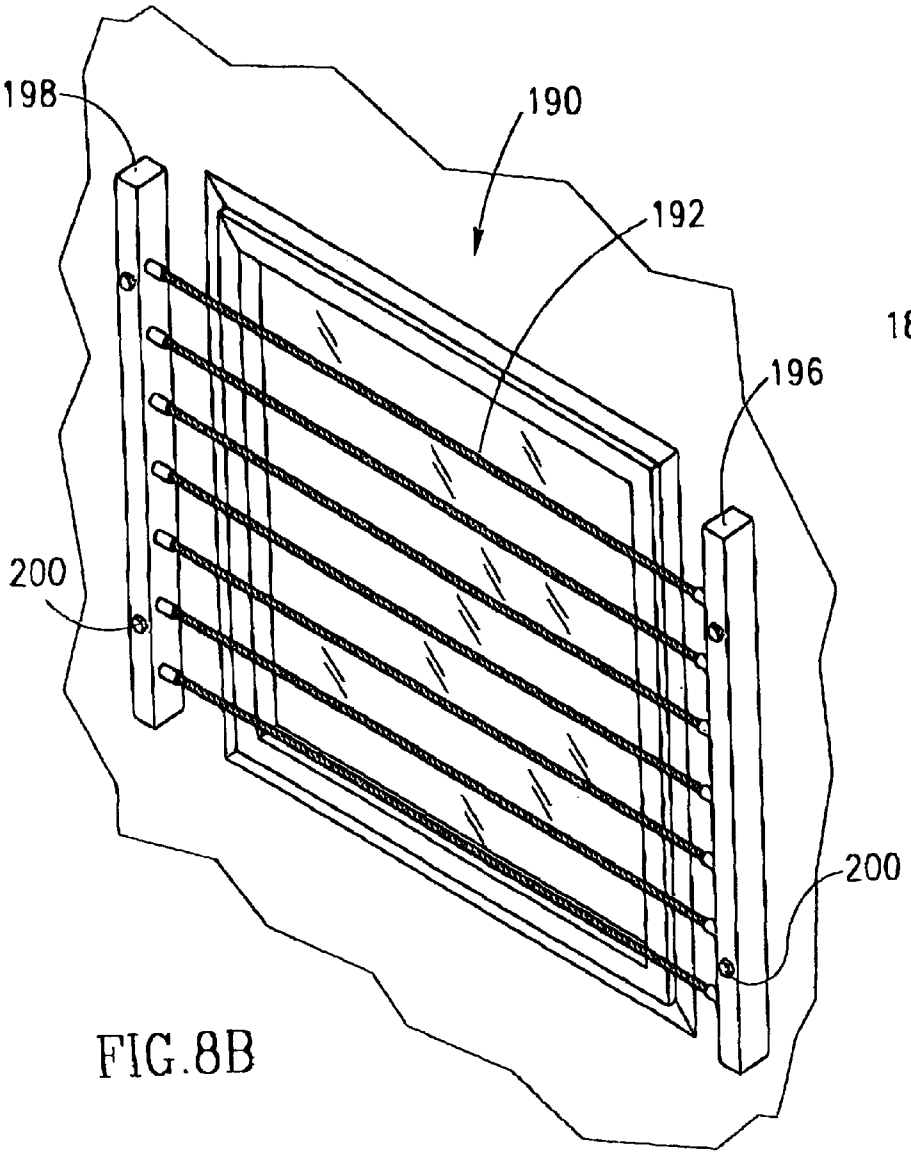

FIGS. 8A and 8B are modifications of an embodiment shown in the previous embodiment, and the reader is directed to those portions of the description referring to the previous figures which apply hereto. In FIG. 8A the window 180 is a fixed window although it may also be an outside swinging casement window of the type referred in FIG. 1, wherein the window 180 is received within an opening 182 in a wall. Rather than being fixed to sash profiles, the pane-engaging members 184 are fixed to opposite wall portions 182 and 186 by means of anchors 188 secured to those respective wall portions by suitable bolts, as known per se.

The window 190 shown in FIG. 8B is also a fixed window though it may be an outwardly opening casement window wherein rather than fixing the pane-engaging members 192 to opposite sash members, they are secured to opposite support profiles 196 and 198 which are in turn fixed to the surrounding wall portions by means of bolts 200. In accordance with this embodiment it is possible to insert energy wasting members into the support profiles 196 and 198 or to secure these support profiles in a manner such that they may deform upon applying axial pressure to the pane-engaging members 192. Profiles 196 and 198 may be single profiles or, by a modification of this embodiment, may constitute a frame.

Figure 9A:
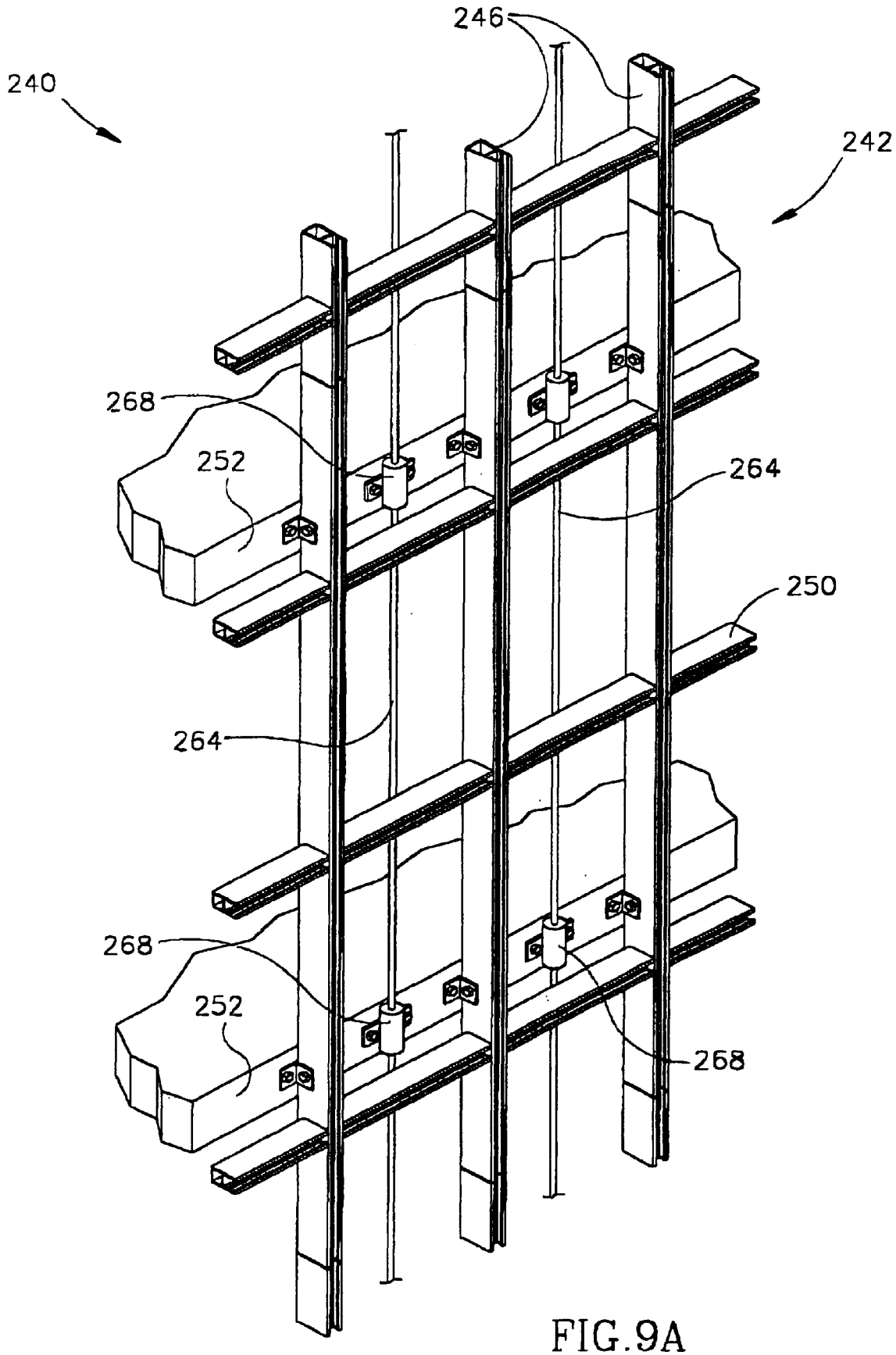
FIGS. 9A and 9B are perspective views of portions of two embodiments, respectively of a curtain wall in accordance with the present invention.
Figure 9B:
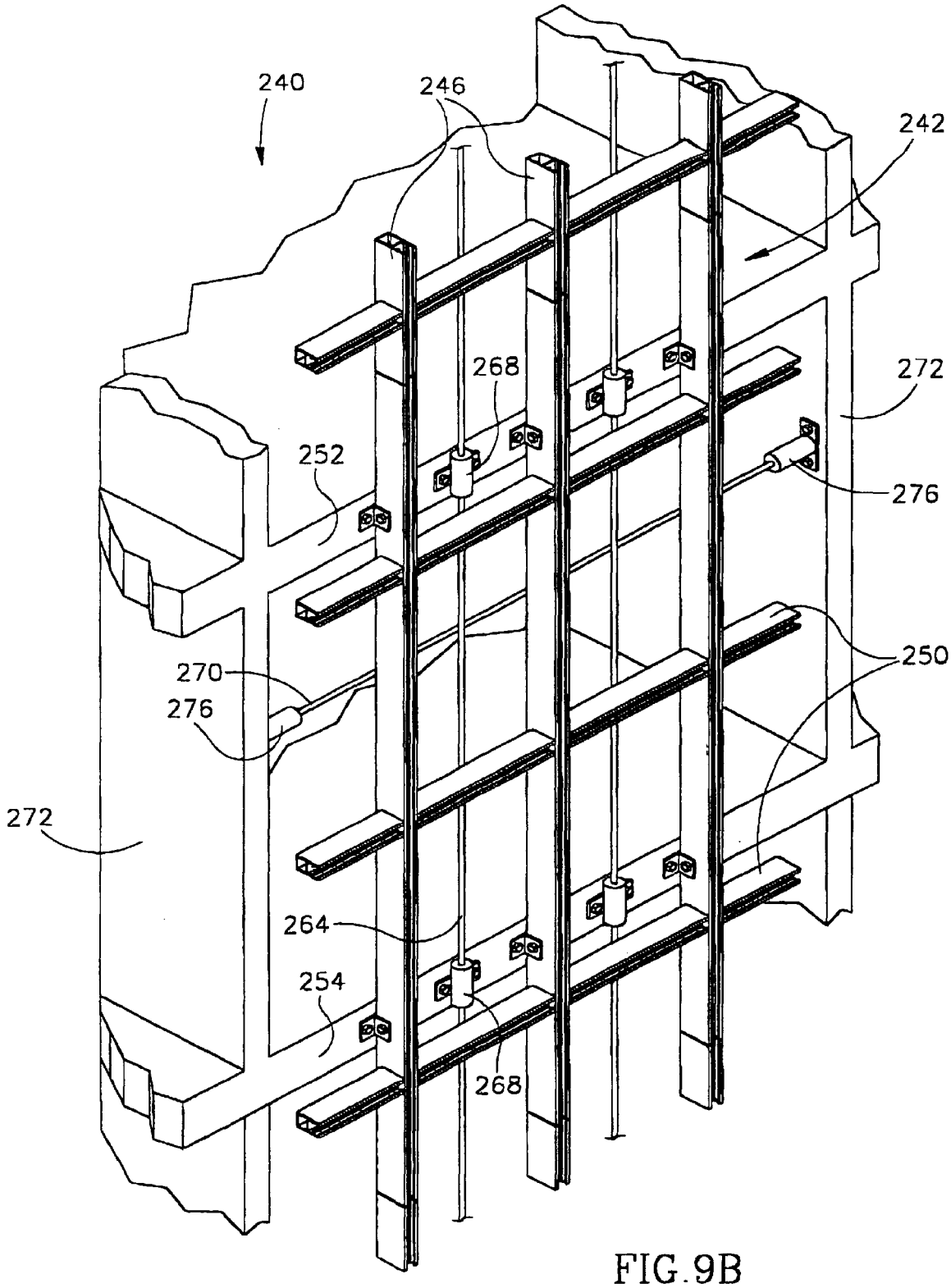

Further attention is now directed to FIGS. 9A and 9B illustrating portions of a curtain wall 240 in which like reference numerals have been given to like elements, for the sake of clarity and simplicity of the description. The chain wall assembly comprises a framework generally designated 242 consisting of a plurality of mullions 246 and a plurality of transums 250 which in the present examples extend at right angles with respect to one another although, as appreciated, this is only a preferred embodiment. The framework 242 is fixedly secured to structural components of the building, namely ceiling 252 and respective floor 254, by means of brackets and bolts, as known in the art.

For the sake of clarity, window panes are not illustrated in FIGS. 8 and 10 although, the artisan is no doubt familiar with different methods for attaching the window panes to the framework of the curtain wall. Typically, but not necessarily, a single window pane is attached to a rectangular formed by intersecting mullions and transums. In accordance with other embodiments, a single window pane extends over more than such a rectangular.

In the embodiment of FIG. 9A, there is provided a pane-engaging member 264 secured to the ceiling 252 and floor 254 by means of energy dispensing devices 268. It is seen that the pane-engaging members 264 extend at an in-side of the framework, namely, do not bear against the window pane.

Energy dispensing devices are of a design similar to that seen in FIG. 6B or, alternatively, as will be explained hereinafter with reference to FIG. 11A. FIG. 9B differs from FIG. 9A in that it comprises additional transversely extending, substantially horizontal pane-engaging member 270 extending between two side walls 272 of the construction and fitted at its respective ends with two energy-dispensing devices 276 which in principle are similar to the device referred to in any of the previous embodiments, e.g. FIGS. 3B, 5 and 7.

As explained hereinabove in connection with previous figures, upon deformation or displacement of a window pane (not shown) as a result of blasts, the window pane engages the pane-engaging member 264 and 270, respectively, giving rise to axial tension force within the pane-engaging members resulting in energy dispensing at the respective energy dispensing device 268 and 276 as explained hereinbefore.

Figure 10A:
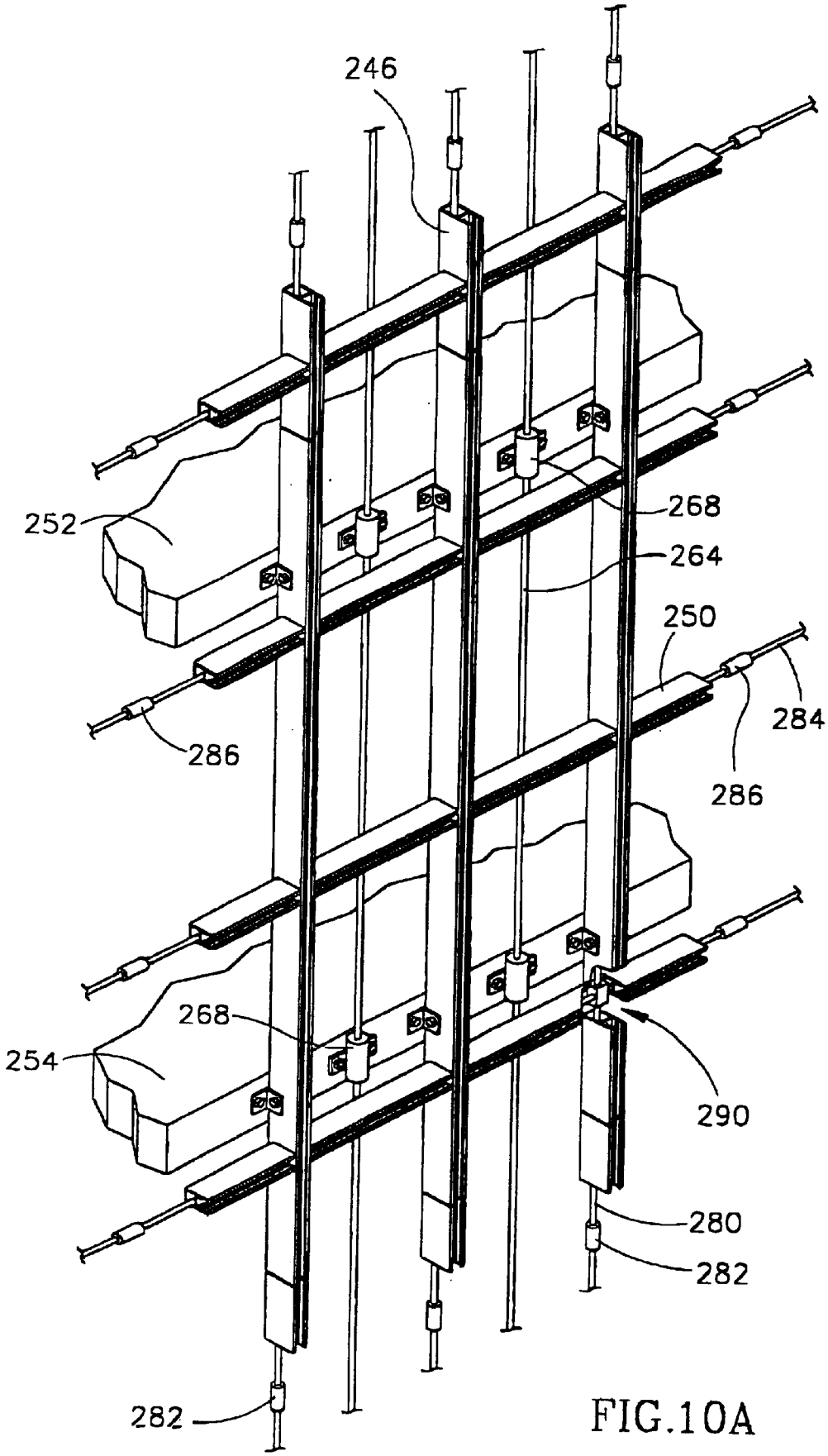
FIG. 10A is a perspective view of a portion of a curtain wall according to one specific embodiment wherein some of the pane-engaging members and framework members are concealed.

FIG. 10 are principally similar to the embodiment of FIG. 9A. In FIG. 10A, in addition to substantially vertically extending pane-engaging members 264 extending essentially vertically between mullions 246, they are provided within the mullions 246 additional frame reinforcing members 280 fitted with a plurality of energy dispensing members 282. Transums 250 receive pane-engaging members and frame support members 284, also fitted with energy dispensing devices 286, respectively.

Figure 10B:
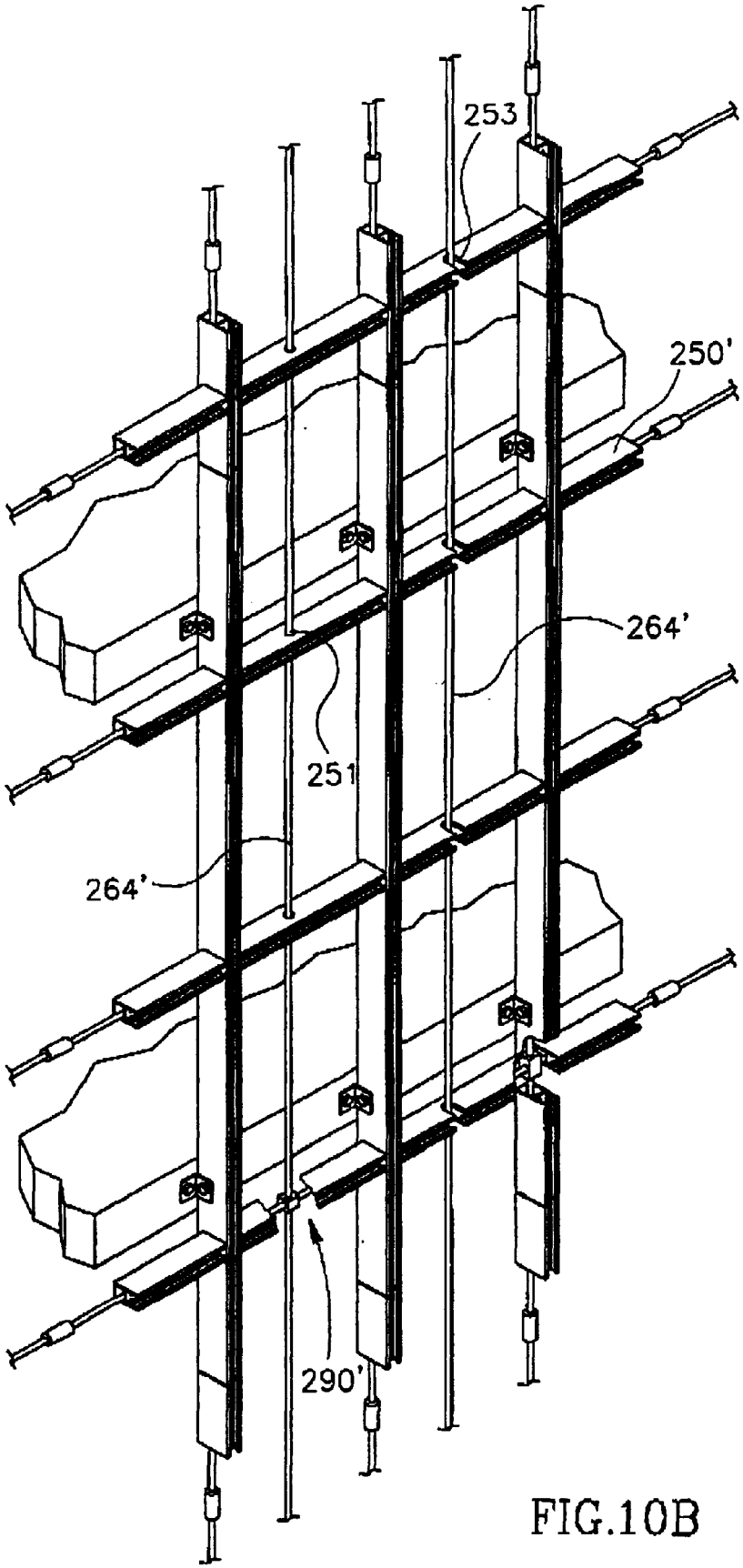
FIG. 10B is a perspective view of a portion of a curtain wall according to a different embodiment.

FIG. 10B illustrates a portion of a curtain wall essentially similar to that seen in FIG. 10A and accordingly, like elements were given similar reference numbers with a prime indication.

The main difference between the embodiment of FIGS. 10B and 10A resides in that the vertically extending pane-engaging members 264' extend through openings 251 formed in transums 250'. It will, however, be appreciated that rather than openings 251 there may be performed indentations 253.

Figure 11A:
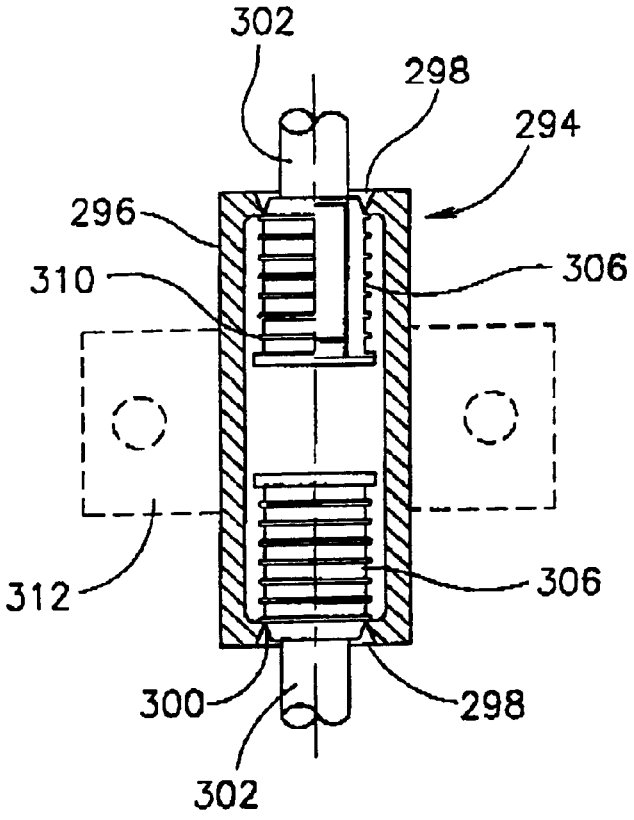
FIGS. 11A and 11B are sectional, schematic views of an embodiment of an energy dispensing device serving as a junction element.
Figure 11B:
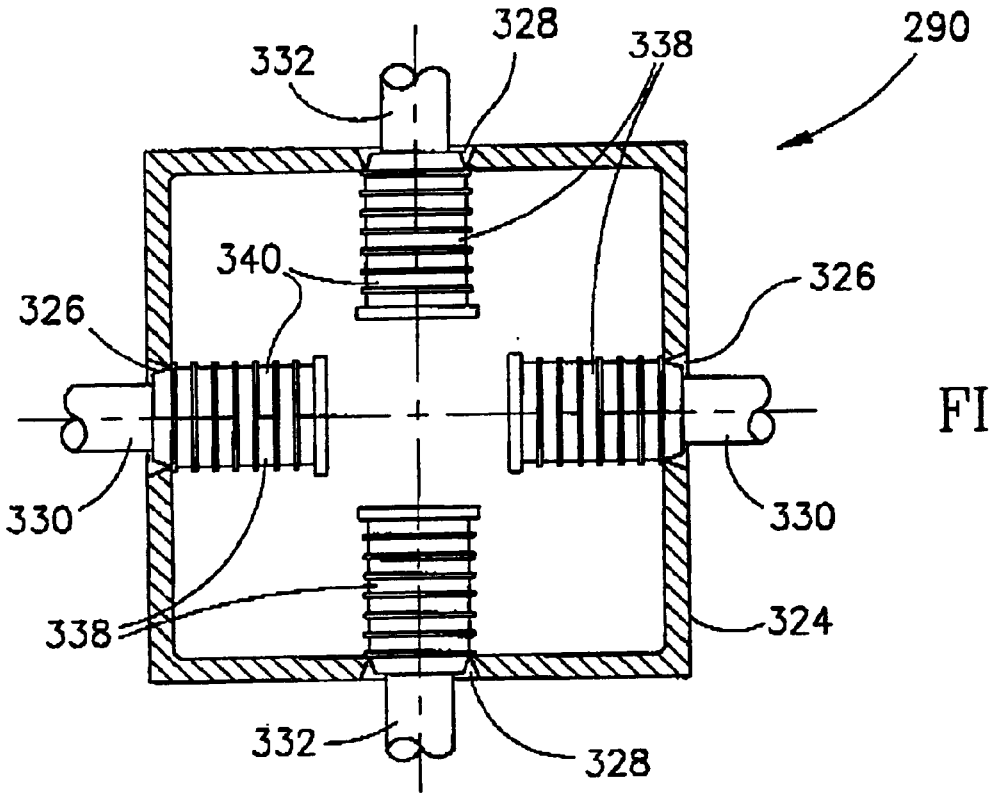

The vertically extending pane-engaging members 264' extend between junction energy dispensing devices 290' which are referred to in more detail in FIG. 11B.

In accordance with the embodiment of FIG. 10B, the vertically extending pane-engaging members 264 extend in closer proximity to the in-side surface of the window pane, as compared with the embodiment of FIG. 10A. This arrangement provides for the window pane to engage with the pane-engaging member sooner than in accordance with the other embodiment.

The arrangement of FIG. 10 provides improved security wherein in addition to preventing the window pane (not shown) from flying inwardly, the framework supporting the window panes is reinforced in itself with a majority of the pane-engaging members and reinforcing members being concealed within the mullions and transums for an eye pleasing effect.

It is also noted that some of the energy dispensing devices 268 are secured to structural components, namely ceiling 252 and respective floor 254, whilst other energy dispensing devices 282 and 286 are not attached to constructional elements, as will be explained hereinafter with reference to FIG. 11A. However, as already mentioned hereinbefore, the energy dispensing devices may constitute part of the framework.

It is further noted that at intersecting points there is provided a special energy dispensing device 290 which will be referred to in more detail with reference to FIG. 11B.

Figure 12A:
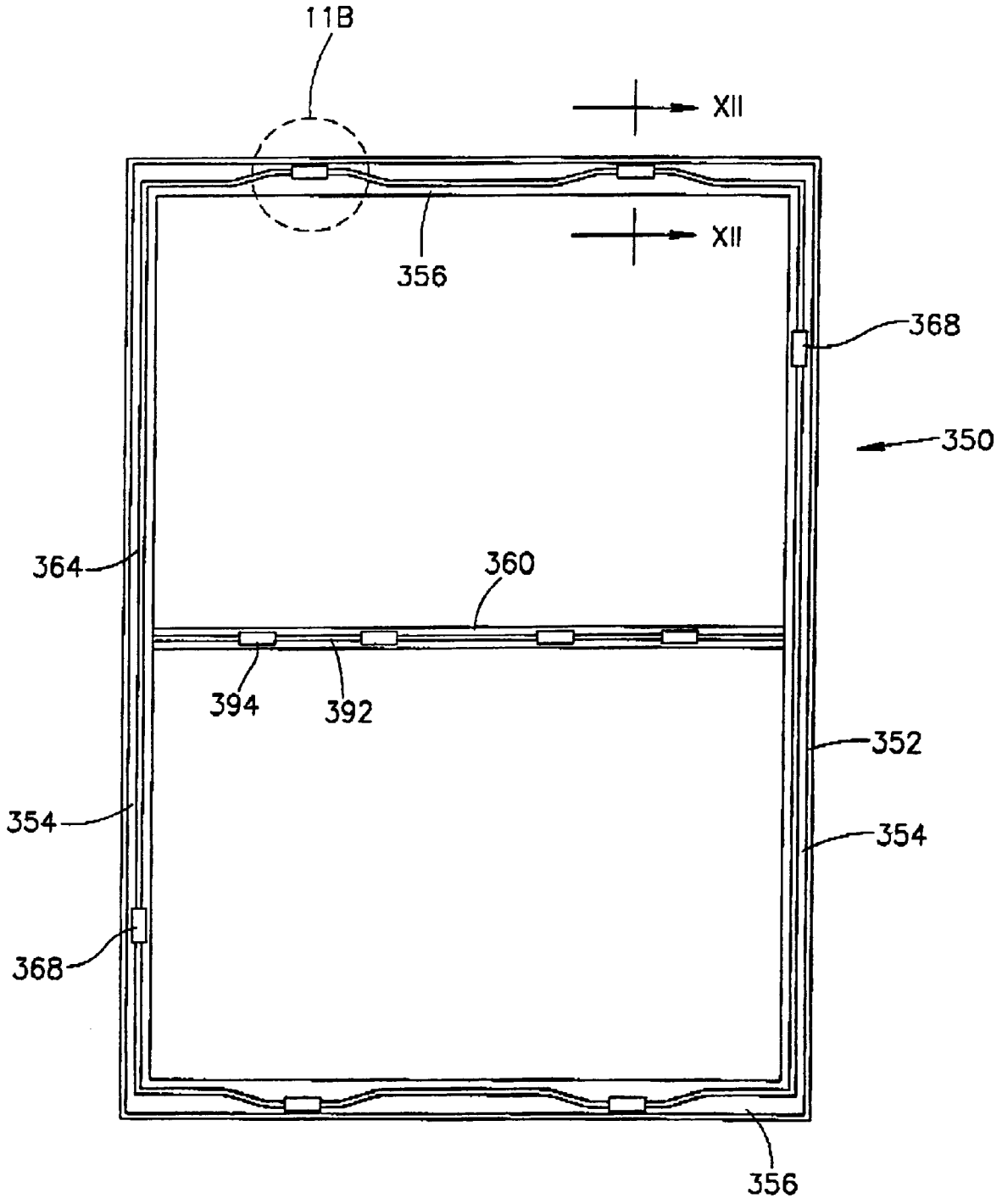
FIG. 12A is a planar view.

In FIG. 12A, there is shown a fixed window frame generally designated 350 comprising a framework 352 holding a window pane (not shown) said framework 352 assembled of a plurality of profiled tubular vertical and horizontal members 354 and 356, respectively, and a transversal, horizontal tubular profiled member 360, the latter being optional.

Optionally, an attaching bracket 312 is provided (shown in dashed lines) for fixedly attaching the device 294 to a construction element as seen, for example, in FIGS. 9A and 9B. Such a bracket may be integral with housing 296 or may be removably attached thereto.

FIG. 11B illustrates an energy dispensing device 290 used as an intersecting device as illustrated for example in FIG. 10. The device comprises an essentially rectangular frame member 324 formed with two opposite pairs of openings 326 and 328, respectively, each formed with a pointed edge, as explained hereinabove with respect to previous figures. The housing 324 receives two pairs of opposite pane-engaging members 330 and 332, respectively, each fitted at its end with a tubular element 338, each in turn formed with a plurality of radial ribs 340 as explained hereinbefore.

The device of FIG. 11B is suitable for use as a junction element which may be either fixed to a construction element or may be a so-called floating member namely, tensioned between respective pane-engaging members. If desired, the device 290 may be secured to a constructional element by suitable bracketing means.

Figure 12B:
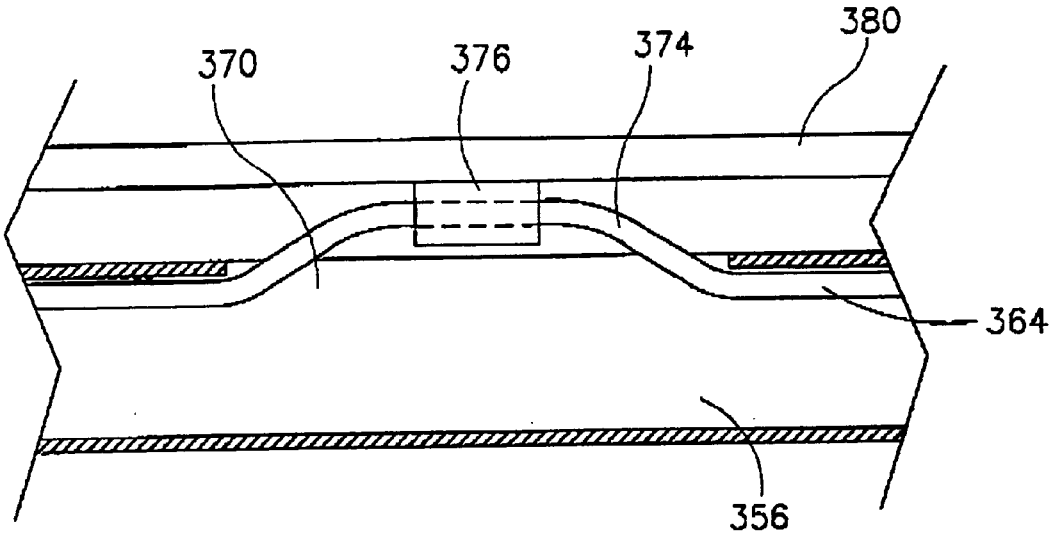
FIG. 12B is an enlarged sectioned view of the portion marked 12B in FIG. 12A.
Figure 13:
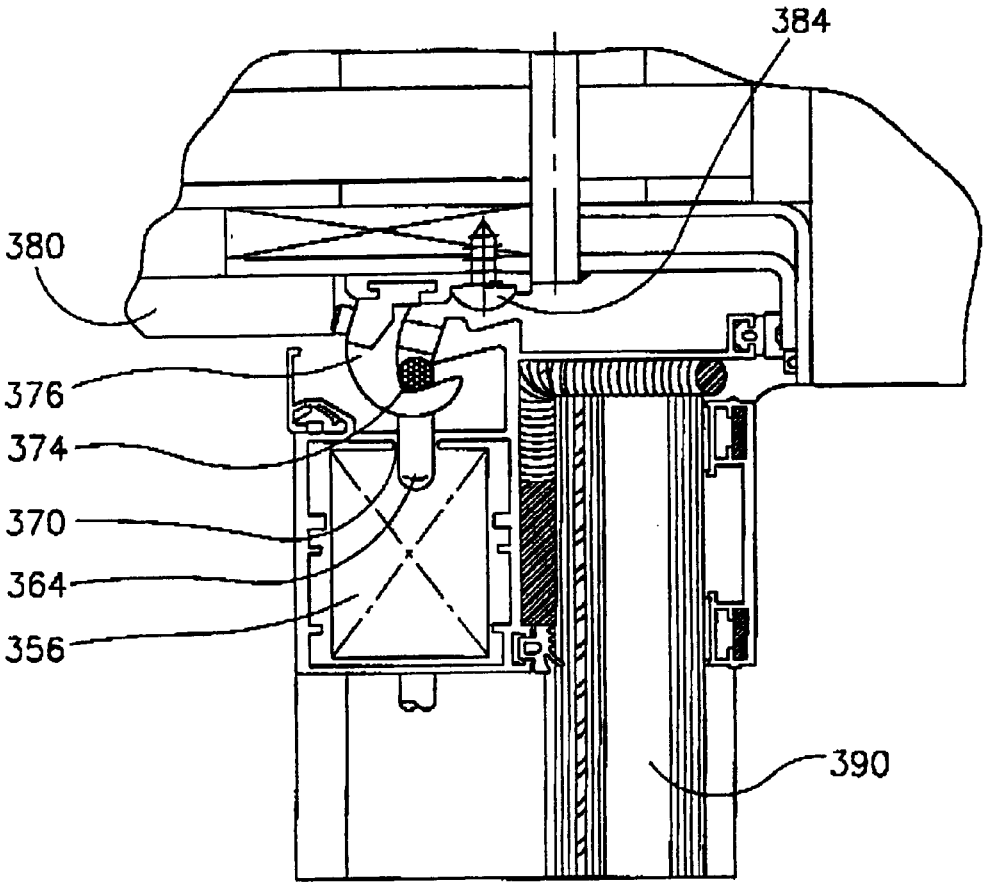
FIG. 13 is a sectional view along line XII—XII in FIG. 12.

Further attention is now directed to FIGS. 12 and 13 for describing a further aspect of a blast resistant window system in accordance with the present invention.

Transversely extending profiled tubular member 360 seen in FIG. 11A is optional and when it is provided it may be fitted with a frame support member 392 in turn fitted with a plurality of energy dispensing devices 394. The frame support member 392 may be fixedly attached to a constructional element (wall, etc.) or to frame support member 364 extending in the vertical profile 354, e.g. by use of a junction energy dispensing device 290 disclosed in FIG. 10B, mutates mutandis.

Framework 352 is adapted for fixedly securing within an opening of a wall (not shown) by conventional means.

Extending within the framework 352 there is a frame supporting member 364 which in fact is a cable made of a flexible and preferably non-elastic material as discussed hereinbefore and which comprises several energy dispensing devices 368 for example, of the type illustrated in, FIG. 11A. The frame support member 364 is continuous and is concealed, together with energy dispensing members 368 within the profiled elements 356, 364 and 360, respectively.

Referring now to the enlarged portion seen in FIG. 12B there are seen more details which are not available in FIG. 12A, wherein the profiled member 356 is formed with an opening 370 through which frame support member 364 projects in a looped shape 374 and is arrested by an anchor 376 fixedly secured to constructional elements namely, to wall portions 380, by means of bolts 384 (FIG. 13). This arrangement can be clearly seen also in FIG. 13 which is a sectional view along line XII—XII in FIG. 12A which, for the sake of illustration, comprises also a portion of a window pane designated 390.

The arrangement disclosed in FIGS. 12 and 13 is suitable for use in case of fixed windows for imparting the framework improved durability and resistance to blast.

Transversely extending member 360 seen in FIG. 12A is optional and when it is provided it may be fitted with a frame support member 392 in turn fitted with a plurality of energy dispensing devices 394. The frame support member 392 may be fixedly attached to a constructional element (wall, etc.) or to frame support member 364 extending in the vertical profile 354, e.g. by use of a junction energy dispensing device 290 disclosed in FIG. 11B, mutatis mutandis.

Although not illustrated, a skilled person will realize that the energy dispensing device may be of different design and have different mechanical properties. For example, the energy dispensing device may be adapted for converting axial tension force into heat, by means of a piston received within a cylinder with suitable restricting means such as a viscous fluid or an aperture of restricted dimensions for escape of compressed fluid.

While preferred embodiments have been shown and described, it is to be understood that it is not intended thereby to limit the disclosure, but rather it is intended to cover all modifications and arrangements falling within the spirit and the scope of the invention as defined in the appended claims.

For example, either or both the energy absorbing system and the reinforced locking assembly may be add-on kits.

Whilst specific embodiments have been disclosed in detail with reference to an inwardly opening casement window and to a fixed window, a skilled person will readily understand that the invention may be applied also to other types of windows as mentioned above or to doors, respectively. Such windows and doors are, for example, sliding windows, fixed walls, outwardly opening casement windows and curtain walls. For that purpose, the required adjustments should be made, e.g. by providing suitable wall brackets for securing the ends of the pane engaging, members and the energy absorbing elements.

What is claimed is:

1. A blast resistant window system, comprising:

anchors fixed to a wall;

a reinforced window pane supported by a framework assembled of a plurality of profiled members and being receivable within an opening in a wall;

a frame support member to impart the framework improved durability and resistance to blast, said frame support member extending within the profiled members; the frame work including a plurality of openings through which the frame support member projects to engage with corresponding anchors.

2. A blast resistant window system according to claim 1, in which said frame support member includes at least one energy dispensing device fitted thereon.

3. A blast resistant window system according to claim 2, wherein the energy dispensing device, further comprises:

a first member having a longitudinal axis;

a second member;

at least one of said first and second members being fixedly attachable to a respective end of a substantially non-elastic window pane engaging member;

one or both of the first and second members include at least one energy wasting member extending along the longitudinal axis, said at least one wasting member bearing against a cooperating surface of the respective other first and second member, wherein axial displacement of the first and second members with respect to one another is converted into a different form of work.

4. A blast resistant window system according to claim 1, wherein the window is a fixed casement window and wherein the frame support member is made of a substantially flexible, but not elastic material.

5. A blast resistant window system according to claim 1, wherein there is further provided a transversal profiled member having respective opposite ends articulated to the profiled members which are situated at the respective opposite ends of the transversal profiled member.

6. A blast resistant window system according to claim 5, in which said transversal profiled member extends adjacent an in-side of the window pane.

7. A blast resistant window system according to claim 5, in which there is further provided a transversal frame support member extending through the transversal profiled member.

8. A blast resistant window system according to claim 1, further comprising:

at least one tensioning member extending within the profiled members, for tensioning the frame support member.

* * * * *